United States Patent [19]

Mulder et al.

[11] Patent Number: 4,874,112

[45] Date of Patent: Oct. 17, 1989

[54] FILTER DISPENSER

[76] Inventors: Merle W. Mulder, 0-288 Begole, SW., Grand Rapids, Mich. 49504; Vernon J. Mol, III, 1627 Havana, SW., Wyoming, Mich. 49509

[21] Appl. No.: 29,088

[22] Filed: Mar. 23, 1987

[51] Int. Cl.[4] ..... B65G 59/00; B65H 1/00

[52] U.S. Cl. ..... 221/1; 221/63

[58] Field of Search ..... 221/63, 51, 45, 46, 221/50; 210/483, 488, 493.5, 497.1, 497.2; 220/406; 206/499, 449, 555, 494; D7/400

[56] References Cited

U.S. PATENT DOCUMENTS

| | | | |
|---|---|---|---|
| 4,098,177 | 7/1978 | Olney et al. | 210/493.5 X |
| 4,182,462 | 1/1980 | Buff, Jr. | 220/406 X |
| 4,266,665 | 5/1981 | Nelson | 221/63 X |
| 4,362,623 | 12/1982 | Holopainen | 210/493.5 |
| 4,444,319 | 4/1984 | Sharber | 206/449 X |
| 4,586,629 | 5/1986 | Loder | 221/46 |
| 4,586,630 | 5/1986 | Loder | 221/46 |
| 4,592,840 | 6/1986 | Brooks | 221/63 X |
| 4,595,502 | 6/1986 | Himmelsbach | 210/493.5 X |
| 4,739,902 | 4/1988 | Joslyn et al. | 221/37 |

OTHER PUBLICATIONS

"Star" Mag., *Mary Ellen*, Dec. 1, 1987.
"Star" coffee filter dispenser box.

*Primary Examiner*—Joseph J. Rolla
*Assistant Examiner*—Gregory L. Huson
*Attorney, Agent, or Firm*—Waters, Morse & Harrington

[57] ABSTRACT

A dispenser for pleated frusto-conical coffee filters has a housing provided with an opening preferably in the face normally forming the bottom, and one or more side openings communicating with the bottom opening. The bottom opening leaves shelves on opposite sides that support a stack of filter papers positioned so that the larger end rests on these shelves. Tabs on the filter papers facilitate the withdrawal of the papers one-by-one, and turning the stack inside-out from the initially pleated condition disengages the edges of the sheets for easier separation.

2 Claims, 2 Drawing Sheets

SECTION-AA

SECTION-AA

FILTER DISPENSER

BACKGROUND OF THE INVENTION

Several brands of coffee makers make use of filter papers that have assumed a standard configuration. Stacks one-half inch to three-quarters of an inch in thickness of sheet material are initially die-cut to form corresponding stacks of paper discs. The radially outer portion of these is pleated in a die system to produce a stack that is frusto-conical, and these are usually packed in cartons for sale. The cartons are usually opened at a top flap along tear lines of perforations, and the papers are withdrawn from the resulting opening as needed.

The cutting and pleating have the effect of interengaging the sheets at the edges and along the pleats to the exent that it can be very difficult to withdraw just one of the papers at a time. Usually, a half-dozen or so will come out in one mass, and these must be separated so that a single one is available, the rest then being shoved back into the carton through the withdrawal opening. Some brands of these filters seem to be more notorious for this tendency, probably due to slight differences in the materials and manufacturing processes.

SUMMARY OF THE INVENTION

The filter container incorporating the present invention has an opening (or a fracture line defining one) in the face normally forming the underside. A side opening communicates with this bottom opening. The stack rests with its large end on the shelves on opposite sides of the bottom opening. The unit is also useable in a position in which the opening is on the top, in which case the container is merely placed upon a counter surface, with the individual filter papers being withdrawn upwardly. Tabs on the papers forming this stack facilitate the separation of the individual papers, these being placed for access at the side openings of the container. The stack is prepared for packaging in the container by turning it inside-out from its initial condition as pleated. The stack is preferably lanced after turning it inside-out to tend to cause the withdrawal of one paper to loosen the next one. In any orientation of the container, the shelves retain the stack so that a single sheet can be pulled through the opening without requiring a two-handed separation.

DESCRIPTION OF THE PREFERRED EMBODIMENTS

Figure 1:
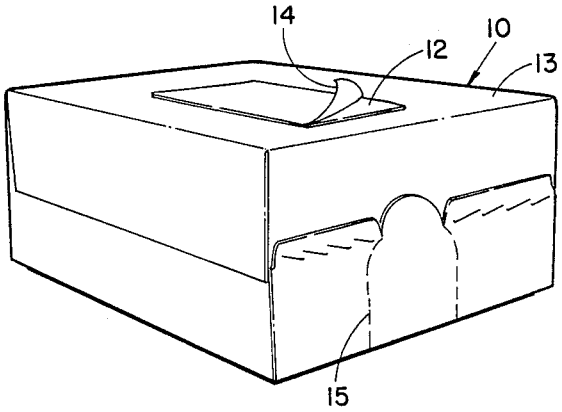
FIG. 1 is perspective view of an unopened carton forming a container of the filter papers.
Figure 6:
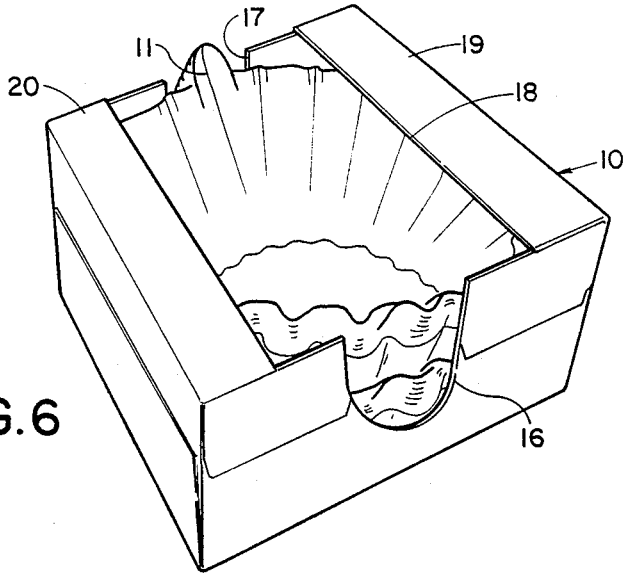
FIG. 6 is a perspective view of a container of filter papers, with the bottom and side openings fully formed. This view will normally correspond to the underside of the container, when the unit is oriented for the withdrawal of the filters by a downward pull.

Referring to FIGS. 1 and 6, the carton generally indicated at 10 forms a container for a frusto-conical stack of filter papers 11. A strip of contact adhesive 12 is provided on the normally top surface 13 of the container, which is exposed by removal of the usual protective sheet 14. The carton may then be adhesively secured to the underside of a kitchen cabinet, shelf, or other similar surface. A pattern of tear lines indicated in FIG. 1 at 15 establishes end openings 16 and 17, and the bottom opening 18. This bottom opening leaves the shelves 19 and 20 to support the larger end of the stack of papers 11, or provide retraint for the stack if the unit is used in the position illustrated in FIG. 6. Individual papers are withdrawn through the opening 18.

Figure 2:
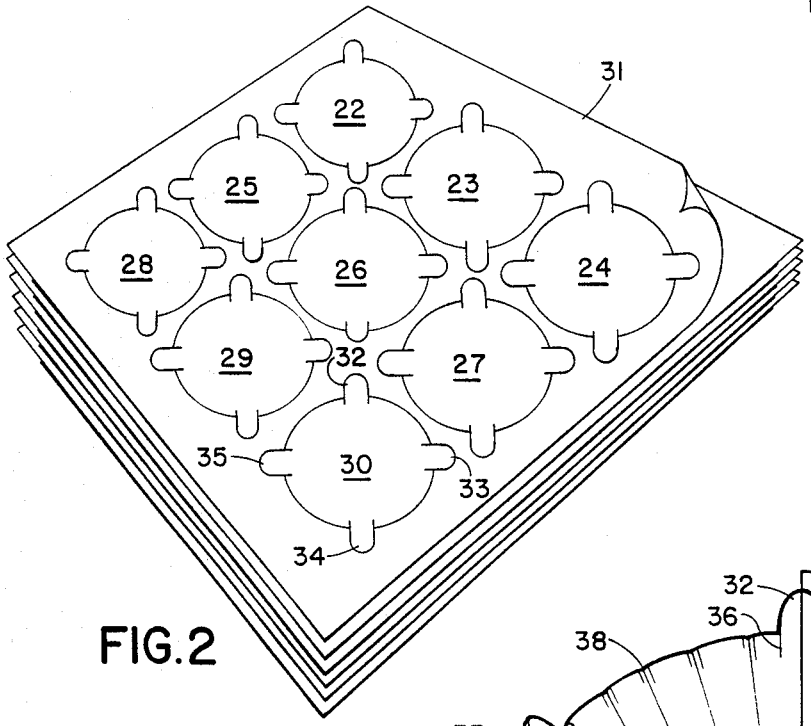
FIG. 2 is perspective view of a stack of sheets in the flat, showing the general arrangement of the resulting discs of filter papers.
Figure 3:
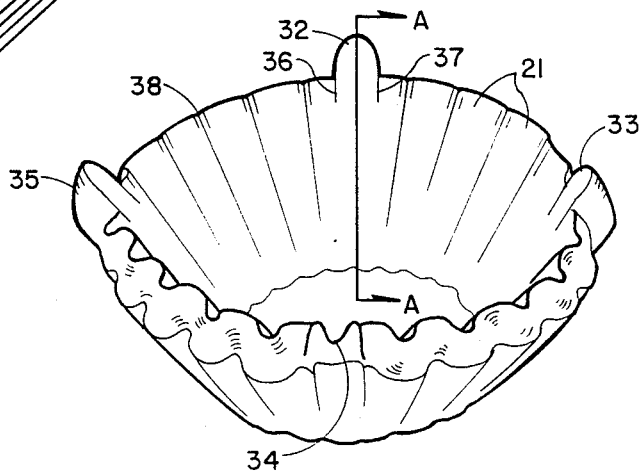
FIG. 3 is a perspective view showing a cut and pleated stack of filter papers.

The frusto-conical stack of papers shown in FIG. 3 has been formed from the flat discs by the addition of the pleats indicated at 21. The initially flat stacks of discs indicated at 22–30 in FIG. 2 are die-cut from a stack of sheets 31 in a conventional manner. Each of these discs are provided with one or more tabs as shown at 32–35, these being oriented to make use of what would otherwise be scrap material in the stack of sheets 31. The resulting flat stack of sheets is then subject to a pleating process in a conventional die system to produce the frusto-conical configuration shown in FIG. 3. In FIG. 3, the tabs are shown as intersected by the pleats. The purpose the tabs is to facilitate the separation of the individual filter papers from the stack, since it is easier to bend the resulting group of tabs to isolate the innermost one than it is to correspondingly isolate the inner sheet by working at its peripheral edge. The number of tabs is optional, probably the most effective being two tabs arranged at the opposite ends of a diameter to correspond with the end openings 16 and 17. These end openings make the outer extremities of the tabs readily available for manipulation. It has been found that the tabs themselves are more easily manipulated and separated by the provision of slits as shown at 36 and 37 extending radially inward from the periphery 38 approximately a quarter of an inch.

Figure 4:
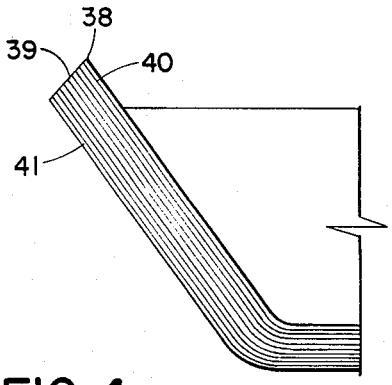
FIG. 4 is a sectional elevation showing the condition of the filter papers as initially pleated.
Figure 5:
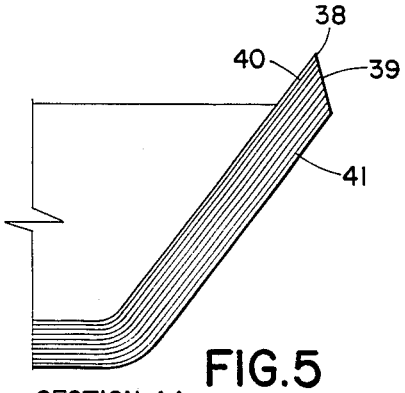
FIG. 5 shows the condition of the stack after the stack has been turned inside-out, and then re-oriented to the same position shown in FIG. 4.
Figure 7:
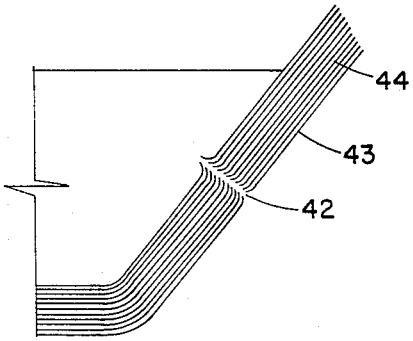
FIG. 7 is a section through the axis of a stack of filter papers after having been lanced to interengage the sheets for successive loosening.

FIG. 4 illustrates the condition of the pleated stack as it emerges from the pleating die. Attention is drawn to the angular relationship of the surface 39 formed by the peripheral edges of the filter papers, with respect to the inner surface 40 and outer surface 41. FIG. 5 shows the same stack after it has been turned inside-out, and then re-oriented into the same position as shown in FIG. 4. The surface 39 now has a new angular relationship to the surface 40 and 41, indicating that the interengagement of the peripheral edges of the discs by the die-cutting operation has been broken, making the individual filter papers much more easily separable. A further procedure may be incorporated in preparation of the stack of filter papers for packaging. This is illustrated in FIG. 7. A pointed needle-like instrument is inserted in the stack from the side to form the pierced hole 42 in the stack 43. This piercing operation is preferably along the same pleat line as that of the tab group 44. Because of the nature of the pierced hole 42, each of the sheets is interengaged to some extent at that point, making it possible for the removal of the inner filter paper to tend to pull the next filter paper into a loosened condition preparatory to its subsequent removal.

Figure 8:
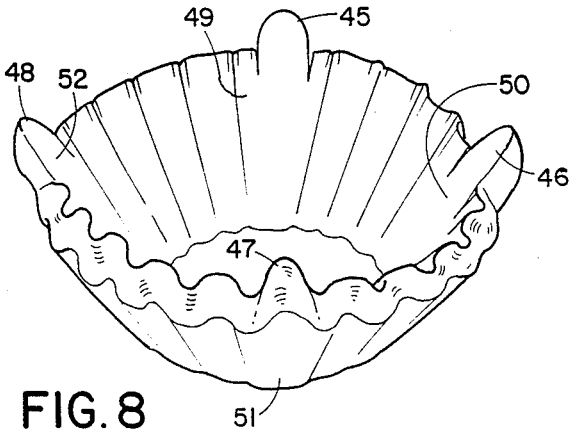
FIG. 8 is a view similar to FIG. 3, but showing a pleated stack of filter papers in which the tabs are formed in unpleated portions.

The modification shown in FIG. 8 is similar to that of FIG. 3, except for the fact that the tab groups 45–48 are formed in conical un-pleated sectors 49–52, respectively. The resulting configuration of the tabs makes them somewhat easier to bend during the releasing operation than would be the case if the intersecting pleats maintained a sufficient degree of curvature to stiffen the tab groups against bending.

Figure 9:
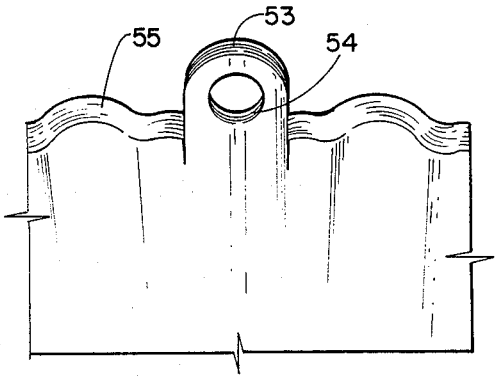
FIG. 9 shows a modified tab configuration, on an enlarged scale.

FIG. 9 shows a modified form of tab, in which a loop configuration 53 is produced by the presence of the holes 54 in each of the filter papers. It is preferable that the holes 54 be beyond the rim 55 to remove the possibility of overflow when the filter is close to its capacity. The loops are disengaged from each other by the turning of the stack inside-out, and thus tend to be easier to grasp and separate.

We claim:

1. A method of preparing a stack of interengaged pleated frusto-conical sheets of material for removal of said sheets one-by-one from said stack, comprising:

turning said stack inside-out.

2. A method as defined in claim 1, additionally including the step of lancing said stack in a substantially radial direction with respect to the axis of said frusto-conical sheets.

* * * * *